US006774294B2

(12) United States Patent
Kugimoto et al.

(10) Patent No.: US 6,774,294 B2
(45) Date of Patent: Aug. 10, 2004

(54) KEY FOR MUSICAL INSTRUMENT

(75) Inventors: Hidenori Kugimoto, Hamamatsu (JP); Jun Ishii, Hamamatsu (JP); Kenichi Ookubo, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 10/201,283

(22) Filed: Jul. 24, 2002

(65) Prior Publication Data

US 2003/0047061 A1 Mar. 13, 2003

(30) Foreign Application Priority Data

Sep. 7, 2001 (JP) ..... 2001-272746

(51) Int. Cl.[7] ..... G10C 3/12
(52) U.S. Cl. ..... 84/433; 84/423 R; 84/440
(58) Field of Search ..... 84/433, 423 R, 84/440, 438

(56) References Cited

U.S. PATENT DOCUMENTS 5,339,719 A * 8/1994 Wasser ..... 84/385 P
6,531,651 B2 * 3/2003 Kanemitsu et al. ..... 84/433
2002/0035913 A1 * 3/2002 Arimori ..... 84/423 R

* cited by examiner

*Primary Examiner*—Shih-yung Hsieh
(74) *Attorney, Agent, or Firm*—Crowell & Moring LLP

(57) ABSTRACT

A key for a musical instrument is provided for facilitating the attachment of a weight, and adjustments of a touch load, while using an alternative material for substitution for lead as a material for the weight. The key comprises a swingable key body formed with embedding holes, and weights each made of a material other than lead and having a threaded outer peripheral surface. The weight is screwed into the embedding hole for removable fit into the key body to give a load to the key body. A plurality of types of weights different in load from one another are provided for selecting one having an appropriate load therefrom to adjust the touch load.

12 Claims, 4 Drawing Sheets

KEY FOR MUSICAL INSTRUMENT

BACKGROUND OF THE INVENTION

1. Field of the Invention

The present invention relates generally to a key for use in a piano and so on, and more particularly, to a key which has a weight attached thereto to provide a desired touch load.

2. Description of the Prior Art

Generally, in a keyboard-based musical instrument, particularly, an acoustic piano such as a grand piano, weights are attached to a key to provide a desired touch load (static load) for the key. Conventionally, the weights are typically made of lead. As illustrated in FIG. 1, a plurality (two in this example) of weights 53 each made of lead of a predetermined size molded into a cylindrical shape are embedded into a plurality of embedding holes 54 formed through a key body 52 made of wood of a key 51 at predetermined positions in front of a balance pin (not shown), and caulked for attachment to the key body 52. The lead is employed as the weights 53 in this manner because the lead has a high specific gravity (approximately 11.3) among other metals, is inexpensive, and exhibits high flexibility and ductility which facilitate works as mentioned above.

Generally, the touch load may be adjusted after the weights 53 have been attached as described above for purposes of eliminating variations in touch load among keys and of matching the touch load for a player's preference. For adjusting the touch load, a side face of a weight 53 is cut away for reducing the touch load since the weight 53 is attached by caulking and therefore removed with difficulties. On the other hand, for increasing the touch load, at least one of previously provided separate adjusting weight 55, made of lead, is additionally attached to the key body 52, as indicated by broken lines in FIG. 1, for the same reason. In this event, a position for attaching the adjusting weight 55 is first determined such that the moment imparted by the adjusting weight 55 about the balance pin is appropriately produced in accordance with the touch load to be added. Then, an embedding hole 56 is additionally formed at the determined attaching position on the key body 52, followed by caulking the adjusting weight 55 for attachment to key body 52. These works are performed for each key 51.

In the conventional key 51 described above, lead is used as the material for the weights 53 for the reasons mentioned above. However, since lead is an injurious material, it is desirable that lead is used for the weights of the keys as least frequently as possible, so that an alternative material is needed for substitution for lead. Also, since the conventional key 51 involves caulking for attaching the weights 53 to each key body 52, this work itself is laborious. Also, since the weight 53 is attached by caulking, the key body 52 is susceptible to cracking due to an impact produced by caulking if the embedding holes 54 are formed at small intervals b, resulting in a limitation in the number of weights 53 attached to the key body 52. Further, due to difficulties in removal of the weights 53 attached by caulking, the adjustment of the touch lead involves the works which include cutting away the side face of each weight 53, forming the embedding hole 56 into the key body 52 while determining the position at which the adjusting weight 55 is attached, and attaching the adjusting weight 55 for each key 51, as described above. As a result, the adjusting works require significant efforts, resulting in an increase in the manufacturing cost.

SUMMARY OF THE INVENTION

The present invention has been made to solve the aforementioned problems, and it is an object of the invention to provide a key which is capable of facilitating the attachment of weights, and adjustments of a touch load, while using an alternative material for substitution for lead as a material for the weight.

To achieve the above object, the present invention provides a key for a musical instrument which is characterized by comprising a swingable key body formed with an embedding hole, and a weight made of a material other than lead and having a threaded outer peripheral surface, wherein the weight is removably fitted in the embedding hole of the key body to a give a load to the key body.

In this key, the weight is made of a material other than lead, and is removably fitted in the embedding hole formed through the key body to give a load to the key body. In this way, since the weight is fitted into the embedding hole by screwing in the present invention, the key body is free from cracking, which would be caused by an impact during caulking as is the case with the conventional weight, even if the embedding holes are formed at small intervals, so that an increased number of weights of can be attached to the key body. It is therefore possible to ensure a load equivalent to or approximate to weights made of lead, even with weights made of a material which is lighter than lead, for example, an approximately metal having a high specific gravity, as a material for the weight. As a result, such a material other than lead can be used as an alternative material for substitution for conventionally used lead. In addition, since the weight is screwed into the embedding hole using a tool, the attachment of the weight to the key body is facilitated, as compared with caulking conventionally used for attaching a weight. Further, since the weight is removable fitted in the embedding hole, the weight can be readily exchanged with another one with different load to readily adjust a touch load.

Preferably, in the aforementioned key for a musical instrument, the weight comprises a plurality of weights different in load from one another.

According to this preferred embodiment of the key, since there are a plurality of weights different in load from one another provided to select therefrom an appropriate one having a load to realize a desired touch feeling, the touch load can be more readily adjusted.

DETAILED DESCRIPTION OF THE PREFERRED EMBODIMENTS

Figure 1:
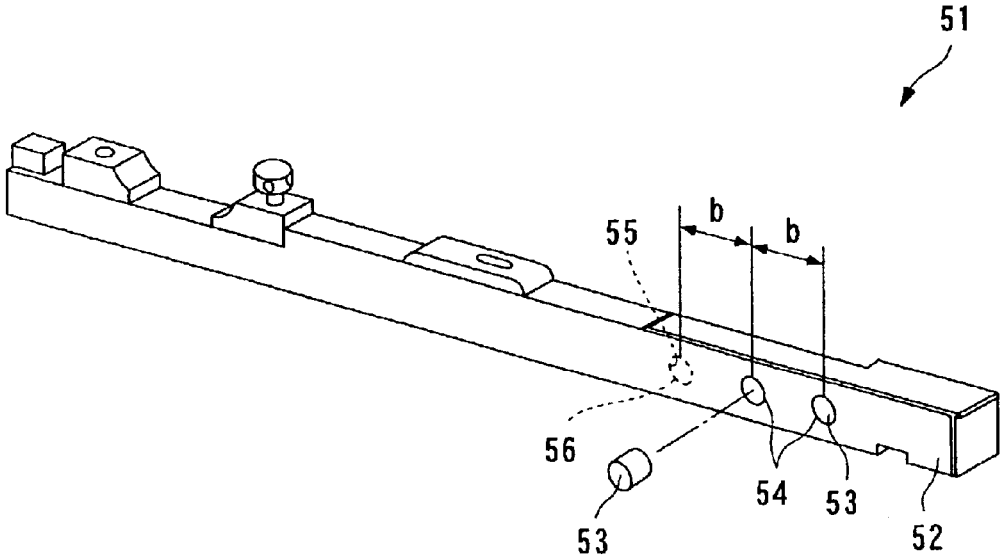
FIG. 1 PRIOR ART
FIG. 1 is a perspective view illustrating a conventional key for a grand piano.
Figure 2:
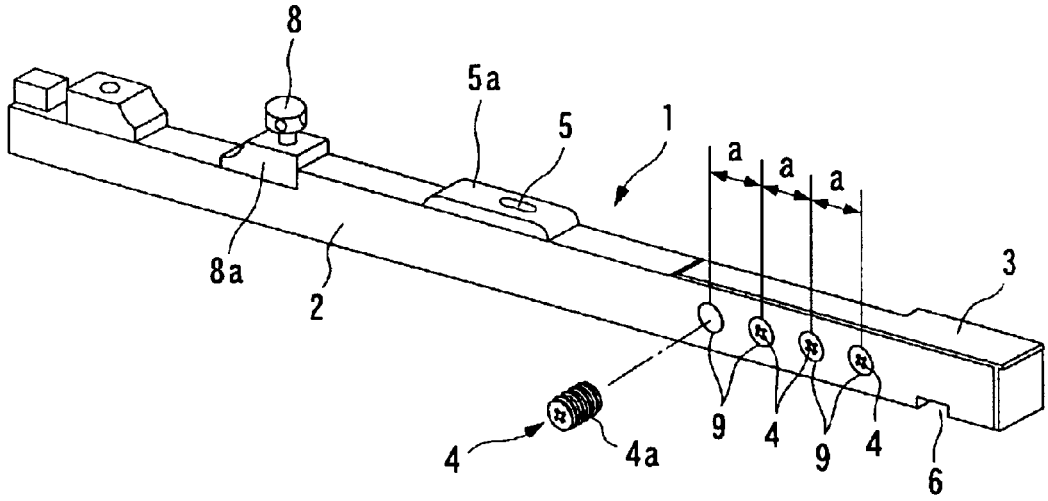
FIG. 2 is a perspective view illustrating a key for a grand piano which embodies the present invention.

In the following, one embodiment of the present invention will be described with reference to the accompanying drawings. FIG. 2 illustrates a key (white key) for a grand piano which embodies the present invention. As illustrated in FIG. 2, this key 1 is comprised of a key body 2, a white key cover 3 attached to a front region of the key body 2; a plurality of weights 4 attached to the front region of the key body 2; and so on.

The key body 2 is made of a wood material such as spruce, pine or the like which is relatively light in weight, viscous and highly elastic, and has a rectangular cross section extending in the longitudinal direction. The white key cover 3 is formed of a molding made of a synthetic resin such as acrylic or the like in an L-shape, and is adhered on a front half of the top and a front face of the key body 2 to cover these areas. A middle plate 5*a* is adhered in a central region on the top of the key body 2, and a balance pin hole 5 is formed through them in the vertical direction. This balance pin hole 5 is engaged with an upright balance pin (not shown) to swingably support the key 1. The key body 2 is also formed with a front pin hole 6 in a front edge region of the bottom thereof. This front pin hole 6 is engaged with an upright front pin (not shown) to prevent horizontal deflection of the key 1.

A capstan screw 8 is further attached to a position behind the balance pin hole 5 on the top of the key body 2 through a capstan plate 8*a*. An action (not shown) is carried on this capstan screw 8. With the foregoing configuration, when a front portion of the key 1 is depressed, the key 1 swings about the balance pin, causing the capstan screw 8 to push up the action for its actuation. A touch load of the key 1 is determined by the balance of a moment produced by the weight of the action and the key 1 about the balance pin.

The key body 2 is also formed with four embedding holes 9, and weights 4 according to the present invention are fitted in these embedding holes 9, respectively. Those embedding holes 9 are formed at predetermined positions on the front side from the balance pin hole 5 of the key body 2 side by side in the longitudinal direction at predetermined intervals a. The interval a is narrower than an interval b at which embedding holes are formed in a conventional key. Further, the embedding holes 9 have a circular cross section and the same predetermined diameter as one another, and are formed extending from one side to the other.

Figure 3:
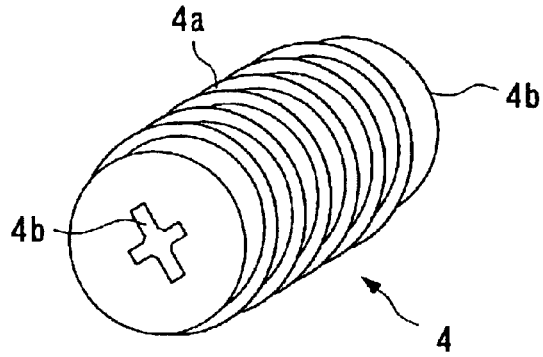
FIG. 3 is a perspective view illustrating a weight.
Figure 4A:
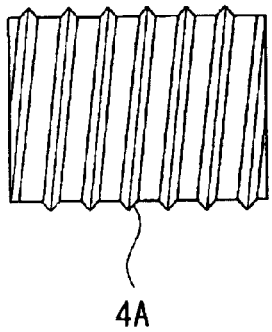
FIGS. 4A–4C are side views illustrating three types of weights which are different in weight from one another.
Figure 4B:
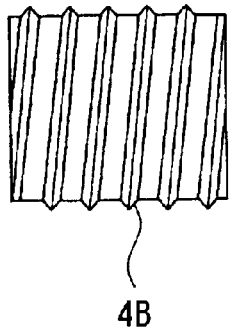
Figure 4C:
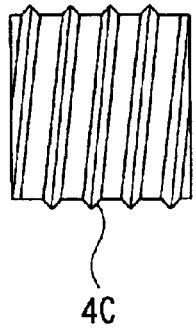

The weight 4 for providing the key body 2 with a load, on the other hand, is in the shape of a cylinder having a predetermined diameter and length, as illustrated in FIG. 3, and is made of a material other than lead, for example, iron. The weight 4 is formed with a thread 4*a* on the outer peripheral surface by a threading work, and with cross-shaped grooves 4*b* in both end faces for a screw driver by a press work. Iron is preferred for the weight 4 because iron is harmless, has a relatively large specific gravity (approximately 7.86) among other metals, and is inexpensive. As illustrated in FIGS. 4A–4C, three types of weights 4A, 4B, 4C have been previously provided as the weight 4. These various types of weights 4A–4C have the same diameter but different lengths from one another. The weight 4 of the foregoing structure can be removably attached to the key body 2 by inserting and rotating a screw driver (not shown) into the groove 4*b* of the key body 2 to drive the weight 4 into the embedding hole 9.

As described above, according to the key 1 of the foregoing embodiments, the weight 4 made of iron is screwed into each embedding hole 9 formed through the key body 2 and removably fitted therein to give a load to the key body 2. Since the weights 4 are fitted by screwing, the key body 2 is free from cracking, which would be caused by caulking as is the case with the conventional weight, even if the embedding holes 9 are formed at small intervals a, so that an increased number of weights can be attached to the key body 2. It is therefore possible to ensure a load equivalent to or approximate to that weights of lead, even with weights made of iron which is lighter than lead. In addition, since the weight 4 is screwed into the embedding hole 9 using a screw driver, the attachment of the weight 4 to the key body 2 is facilitated, as compared with caulking conventionally used for attaching a weight.

Also, since the weight 4 is removably fitted in the key body 2, and three types of weights 4A, 4B, 4C different in load are previously provided as the weight 4, one having an appropriate load can be selected from these options and attached to the key body 2 to readily and properly adjust the touch load of the key. For example, each key body 2 is formed with three embedding holes 9 of the same size at the same locations, and the touch load is measured with the weights 4 fitted in the embedded holes 9. By exchanging any weight 4 with another weight 4A–4C having an appropriate load in accordance with the result of measurement, a desired touch load can be readily provided for the key. This results in complete elimination of the cutting of the weight for reducing the touch load, additional provision and positioning of the embedding hole and a weight for increasing the touch load in the prior art. As such laborious works are omitted, the manufacturing cost of the key 1 can be reduced correspondingly.

Figure 5:
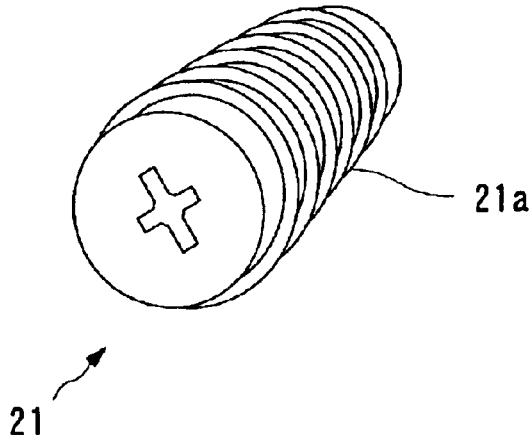
FIG. 5 is a perspective view illustrating another weight.
Figure 6:
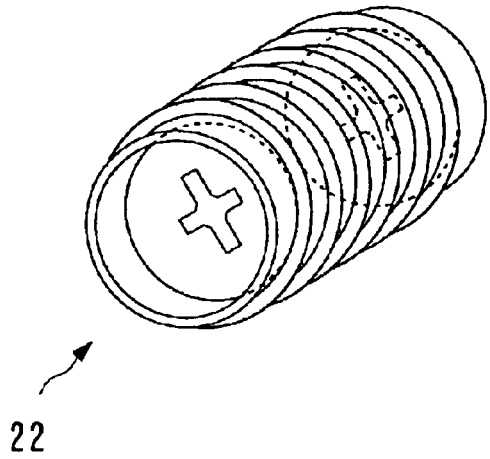
FIG. 6 is a perspective view illustrating a further weight.

FIGS. 5 and 6 illustrate other examples of weights, respectively. Though not shown, a plurality of types of weights different in load from one another are provided for these weights 21, 22. The weight 21 illustrated in FIG. 5 has the outer peripheral surface, including a screw head 21*a*, slowly tapered along the lengthwise direction, which helps insert and screw the weight 21 into the embedding hole 9. The weight 22 illustrated in FIG. 6, in turn, is formed with spot facings on both end faces. This can change the load of the weight 22 without changing the length of the same. Though not shown, hexagonal recesses may be formed in both end faces of the weight instead of the groove 4*a* for a screw driver such that the weight is screwed into the embedding hole 9 using a hexagonal wrench.

As described above, the key according to the present invention advantageously facilitates the attachment of the weight thereto, and adjustment of the touch load, while using an alternative material for substitution for lead as the material for the weight.

It should be understood that the present invention is not limited to the foregoing embodiment but may be practiced in a variety of manners. For example, while the foregoing embodiment shows the weight made of iron, any suitable material other than lead may be employed as long as it can ensure a required load. For example, such a required load can be ensured by using brass (specific gravity is 8.2) or the like as another metal, or a molding or the like which may be made by blending nylon with tungsten (specific gravity is 19.3) as a composite material of a metal and a synthetic resin. In the latter case, a threading work can be omitted as well by molding a threaded weight. Also, in the foregoing embodiment, the touch load is adjusted by exchanging the weights 4 fitted in the four embedding holes 9 as appropriate. A method of adjusting the touch weight, however, is not limited to the exchange of the weights. Alternatively, for example, an embedding hole may be provided separately for adjustment such that the touch load is adjusted by selecting as appropriate a weight which is to be fitted into the embedding hole for adjustment.

While the foregoing embodiment shows an example in which the present invention is applied to a key for a grand piano, the present invention can be applied to any key to which a weight is attached, such as keys for an upright piano, an electronic piano, a keyboard-based toy, and the like. Otherwise, the present invention can be modified as appropriate in its details without departing from the spirit and scope of the invention defined by the appended claims.

What is claimed is:

1. A key for a musical instrument comprising:

a swingable key body formed with at least one embedding hole; and at least one weight made of a material other than lead and having a threaded outer peripheral surface, each of said at least one weight being removable fitted in one of said at least one embedding hole of said key body to thereby adjust a touch load of said key body.

2. A key according to claim 1 wherein:

each said weight is chosen from a plurality of weights which differ in load from one another.

3. A key according to claim 1 or 2, wherein said material other than lead is iron.

4. A key according to claim 1 or 2, wherein said material other than lead is brass.

5. A key according to claim 1 or 2, wherein said material other than lead is tungsten and nylon.

6. A key according to claim 1 or 2, wherein said at least one embedding hole is disposed laterally through said key body near one end thereof.

7. A key according to claim 6, comprising a plurality of said embedding holes.

8. A key according to claim 1 or 2, wherein said at least one weight is tapered.

9. A key according to claim 1 or 2, wherein said weight has a spot facing at at least one end thereof to thereby change the load of the weight without changing the length thereof.

10. A key according to claim 1 or 2, wherein said threaded weight is removably fitted in said embedding hole by screwing said weight into said hole.

11. A key according to claim 1 or 2, wherein said musical instrument is a keyboard musical instrument.

12. A method of adjusting the touch load of a key for a musical instrument which comprises a swingable key body formed with at least one embedding hole, said method comprising providing at least one weight made of a material other than lead and having a threaded outer peripheral surface and removably fitting said weight in each said at least one embedding hole.

* * * * *